US007753804B2

(12) United States Patent
Sposato

(10) Patent No.: US 7,753,804 B2
(45) Date of Patent: Jul. 13, 2010

(54) BOWLING BALL WITH WEIGHT BLOCK

(75) Inventor: Richard Sposato, Syracuse, NY (US)

(73) Assignee: Lane No. 1, Syracuse, NY (US)

( * ) Notice: Subject to any disclaimer, the term of this patent is extended or adjusted under 35 U.S.C. 154(b) by 187 days.

(21) Appl. No.: 11/780,824

(22) Filed: Jul. 20, 2007

(65) Prior Publication Data

US 2009/0023508 A1 Jan. 22, 2009

(51) Int. Cl.
*A63B 37/06* (2006.01)

(52) U.S. Cl. ..... 473/126

(58) Field of Classification Search ..... 473/125, 473/126

See application file for complete search history.

(56) References Cited

U.S. PATENT DOCUMENTS 5,037,096 A * 8/1991 Pinel et al. ..... 473/126
5,125,656 A * 6/1992 Fabanich ..... 473/126
5,238,245 A * 8/1993 Sposato ..... 473/126
5,525,118 A * 6/1996 Mock ..... 473/125
5,951,407 A * 9/1999 Teitloff ..... 473/126

* cited by examiner

*Primary Examiner*—William M Pierce
(74) *Attorney, Agent, or Firm*—George R. McGuire; Frederick J M Price; Bond Schoeneck & King, PLLC

(57) ABSTRACT

A bowling ball having an asymmetrical weight block with respect to its central axis. The weight block has a pair of ends through which the central axis of the block extends, and a medial portion which is offset or skewed with respect to the weight block axis. The block has an outer surface which has a maximum cross section in at least one plane intersected by the central axis intermediate of the two ends. The plane is intersected by the central axis and is enclosed by a boundary defining the largest transverse cross section of the block not normal to the central axis. The medial plane is disposed at an angle of between about 22.5° and 90° with respect to the central axis of the block.

2 Claims, 2 Drawing Sheets

BOWLING BALL WITH WEIGHT BLOCK

BACKGROUND OF THE INVENTION

The present invention relates to bowling balls, and more particularly to bowling balls incorporating an internal weight block of novel configuration for effecting ball performance in a positive manner.

Weight blocks of various sizes and shapes have been incorporated in bowling balls in order to alter the performance of the ball as it travels down the alley and impacts the pins. Such blocks are disclosed, for example, in U.S. Pat. No. 5,238,245 and its Reissue (Re. 35,448), of the present applicant, as well as U.S. Pat. Nos. 5,037,096, 5,389,042, and 6,027,412 all of Pine et al. The weight blocks may be of essentially symmetrical form and incorporated in the ball with the geometric center of the ball and the weight block coincident, or with the weight block and/or its position within the ball symmetrical.

SUMMARY OF THE INVENTION

The weight block of the present invention is asymmetrical with respect to a central axis. That is, the weight block has a pair of ends through which the central axis of the block extends, and a medial portion which is offset or skewed with respect to the weight block axis. The block has an outer surface which has a maximum cross section in at least one plane intersected by the central axis which is intermediate of the two ends. This plane, i.e., the plane intersected by the central axis which is enclosed by a peripheral boundary defining the largest transverse cross section of the block is preferably in a flat plane which is not normal to the central axis. Rather, the medial plane is disposed at an angle, preferably of about 22.5° but in any case other than 90°, with respect to the central axis of the block. The plane of largest cross section is preferably about midway between the two ends of the weight block. The asymmetry of the weight block produces a spin and roll of the ball wherein it is incorporated which ultimately results in greater pin action and thus higher scores. The object of the invention is to provide a bowling ball incorporating a novel and improved weight block which improves the bowlers opportunities of achieving improved scores. Other objects will in part be obvious and will in part appear hereinafter.

The foregoing and other features of construction and operation of the invention will be more readily understood and fully appreciated from the following detailed description, taken in conjunction with the accompanying drawings.

DETAILED DESCRIPTION

Figure 1:
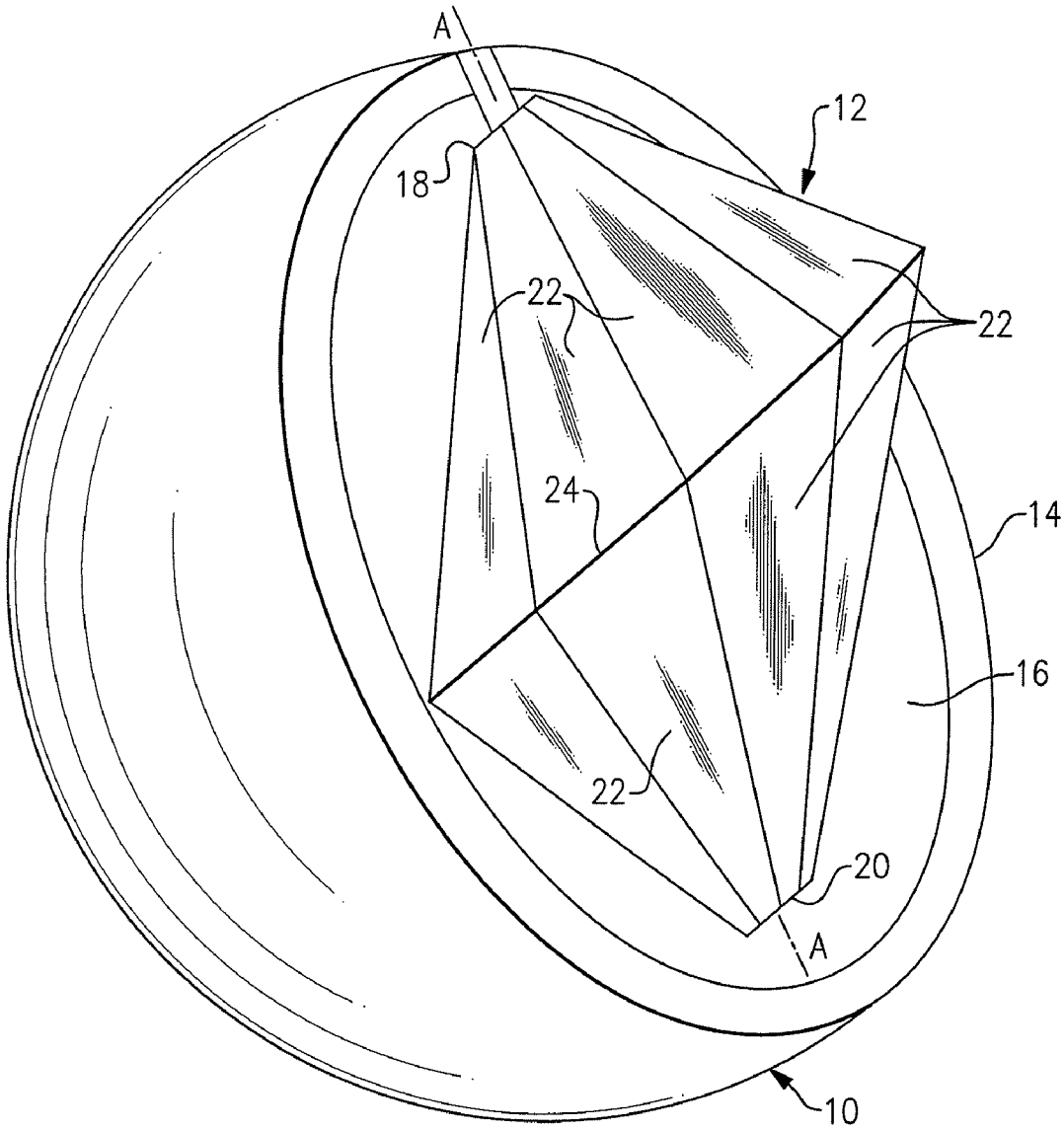
FIG. 1 is a perspective view of a bowling ball incorporating the weight block of the invention with substantially one half of the ball broken away to show the block.

In FIG. 1 is shown a bowing ball, denoted generally by reference numeral 10, internally incorporating weight block 12, incorporating the present invention. Ball 10 includes spherical outer shell 14 enclosing core 16 which may be of the same or different material as shell 14. Grip holes are drilled in conventional fashion in the outer surface of ball 10 to fit the grip of an individual who will use the ball.

Figure 2:
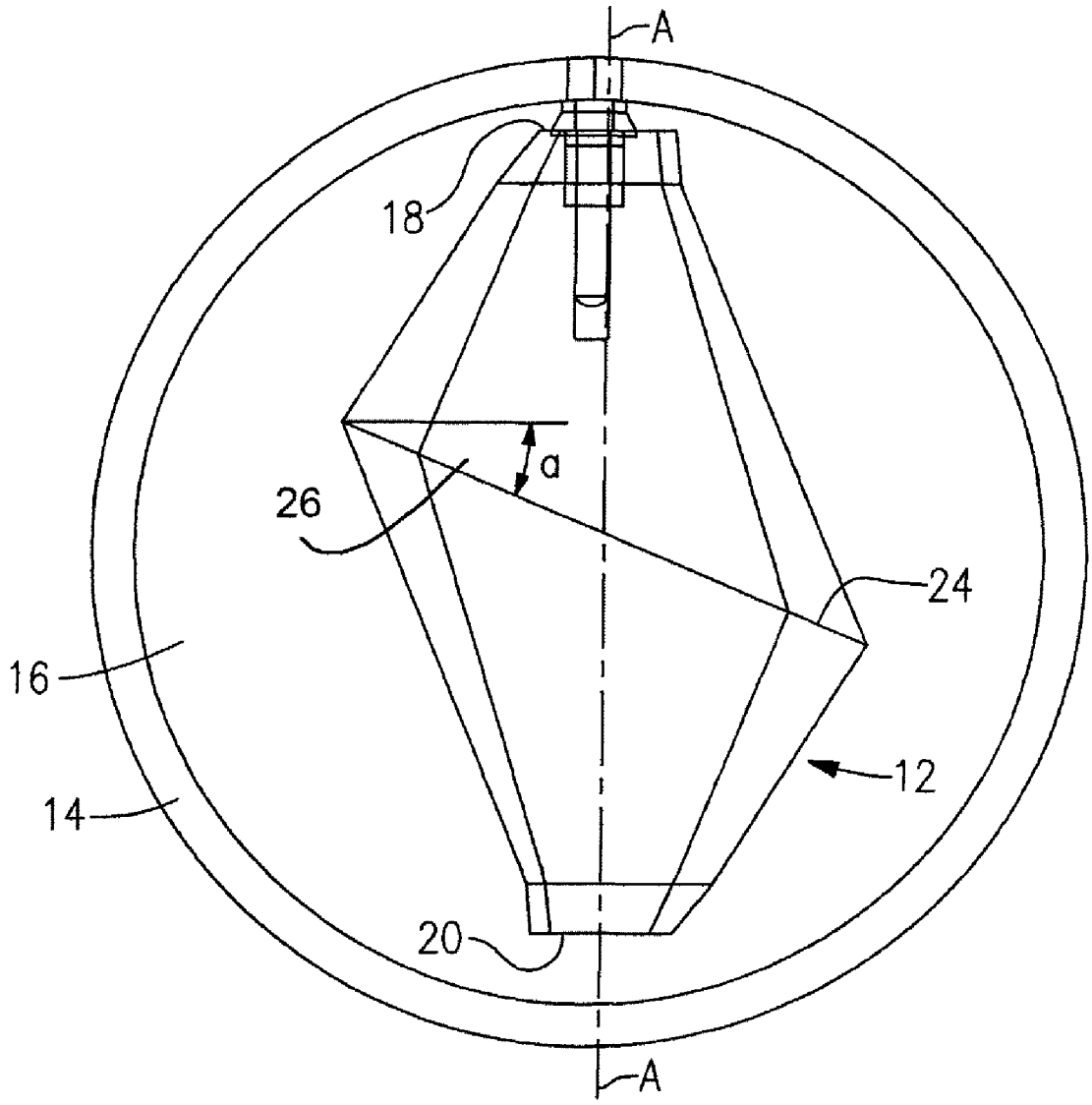
FIG. 2 is an elevational view of an injection mold for fabricating balls and weight blocks such as those of FIG. 1.

Weight block 12 is seen to have two ends 18 and 20 with a central axis A-A extending through both ends. In the illustrated embodiment, the outer surface of block 12 is formed of a plurality of adjacent, flat segments 22 which taper outwardly from both of ends 18 and 20 to meet at an intermediate plane defined by peripheral boundary 24. As is particularly evident in FIG. 2, the flat plane surrounded by boundary 24 is skewed or angled with respect to axis A-A. That is, rather than lying in a plane normal to the axis, the plane surrounded by boundary 24 is arranged at an angle "a" of, for example, 22.5° to the plane indicated by reference numeral 26, although the angle may be varied as desired. Boundary 24 may be configured to enclose a curved, rather than a flat plane, and conceivably more than one boundary defining a plane which is skewed with respect to the central axis of weight block 12 could be provided.

The asymmetry of the weight block, and thus the center of mass of the ball, gives the ball a certain degree of instability as it travels down the lane. This creates ball travel characteristics known in the art as wobble, lope and flip which an experienced bowler may employ to improve the pin action, ultimately providing an opportunity to improve overall score.

What is claimed is:

1. A bowling ball comprising a weight block, the weight block being unitary and comprising:

a peripheral boundary;

a top end; and a bottom end;

wherein:

the top and bottom ends define a central axis perpendicular to both the top and bottom ends, and outer surfaces of each end meet at an intermediate plane defining said peripheral boundary;

the peripheral boundary includes a unique medial perimeter; and said unique medial perimeter defines an at least substantially planar medial cross-section defining a largest transverse cross section of said weight block where the medial cross-section is at a skew angle to the central axis.

2. The member of claim 1, wherein said outer surfaces comprise a plurality of adjacent flat segments.

* * * * *